United States Patent [19]

Kropiwnicki et al.

[11] Patent Number: 4,795,316

[45] Date of Patent: Jan. 3, 1989

[54] COMPRESSOR SUCTION PULSE ATTENUATOR

[75] Inventors: Tadek M. Kropiwnicki; Joseph E. Braymer, both of Syracuse; Nelik I. Dreiman, Manlius, all of N.Y.

[73] Assignee: Carrier Corporation, Syracuse, N.Y.

[21] Appl. No.: 637,644

[22] Filed: Aug. 3, 1984

[51] Int. Cl.[4] ..... F04B 39/16

[52] U.S. Cl. ..... 417/312; 417/540; 417/902; 181/403

[58] Field of Search ..... 417/540, 542, 312, 902; 181/229, 238, 403, 240, 272

[56] References Cited

U.S. PATENT DOCUMENTS

| | | | |
|---|---|---|---|
| 2,286,272 | 6/1942 | Higham | 417/902 X |
| 3,396,903 | 8/1968 | Oya | 417/902 X |
| 3,876,339 | 4/1975 | Gannaway | 417/312 |
| 4,313,715 | 2/1982 | Richardson, Jr. | 417/902 X |
| 4,411,600 | 10/1983 | Hagaki et al. | 417/902 X |

*Primary Examiner*—Andrew V. Kundrat
*Assistant Examiner*—Peter M. Cuomo
*Attorney, Agent, or Firm*—David J. Zobkiw

[57] ABSTRACT

Each piston is provided with a suction plenum and the suction plenums are connected through restricted openings. This causes the suction inlets to be connected to a plurality of cylinders resulting in a continuous flow of gaseous refrigerant in each of the suction tubes.

3 Claims, 4 Drawing Sheets

COMPRESSOR SUCTION PULSE ATTENUATOR

BACKGROUND OF THE INVENTION

As hermetic motor-compressor units have become increasingly more compact, a number of new problems have been introduced which require solutions. Noise generation has become a major problem resulting from the more compact configurations. As expected, discharge noises are increased in the more compact configurations, but suction side noise generation has reached a noise level requiring a solution especially in view of the noise reduction measures taken on the discharge side.

SUMMARY OF THE INVENTION

In a multi-cylinder reciprocating hermetic compressor, the suction plenum for two opposed cylinders is divided into two chambers by a partition. The partition has a pair of orifices providing a partially restricted communication between the two chambers. A pair of suction inlets are in fluid communication with each of the chambers. As a result, each chamber can receive suction gases directly from the associated suction inlets or from the other chamber via a fluid path serially including the suction inlets of the other chamber, the other chamber and the orifices. Because of the different lengths of the flow paths as well as the restricting effect of the orifices, the chambers each primarily supply the associated piston chamber. However, because there is communication to both chambers from each of the suction inlets, there is a continuous flow in each suction inlet rather than a cyclic on-off flow depending upon the piston stroke. Although the flow is continuous through each inlet, the amount of flow varies depending upon which cylinder is in the suction stroke, and the gas flow is smoothed.

It is an object of this invention to optimize suction pressure pulse attenuation.

It is another object of this invention to reduce intake noise.

It is a further object of this invention to connect each suction tube to a plurality of piston chambers via paths of different lengths and to connect each piston chamber to two suction tubes via paths having different lengths. These objects, and others as will become apparent hereinafter, are accomplished by the present invention.

Basically, the piston chamber of a first cylinder is in fluid communication with the suction gas via two flow paths. The first flow path is shorter than the second relative to the first piston chamber and, additionally, there is a restriction in the second flow path relative to the first piston chamber. The piston chamber of a second cylinder is in fluid communication with the suction gas via the same two flow paths. The first flow path is longer than the second relative to the second piston chamber and contains a restriction relative to the second piston chamber. This arrangement provides a suction flow in each flow path which is dependent on a plurality of cylinders whereby a continuous flow occurs in each suction path.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
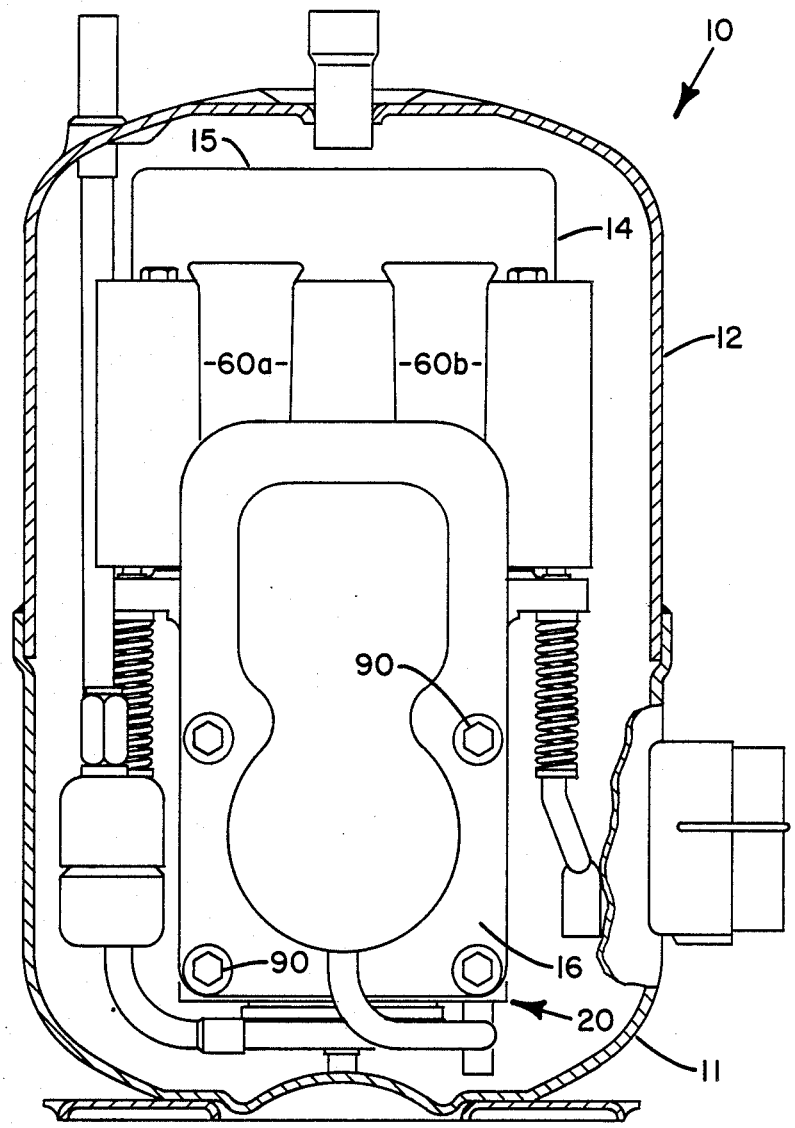
FIG. 1 is a sectioned view of a motor-compressor unit employing the present invention.

In FIG. 1, the numeral 10 generally designates the hermetic motor compressor unit which is in a shell made up of a lower section 11 and an upper section 12 which are welded together. An electric motor 14 and a compressor 16 are disposed within the shell. The compressor 16 is axially aligned with motor 14 and is disposed therebelow.

Figure 2:
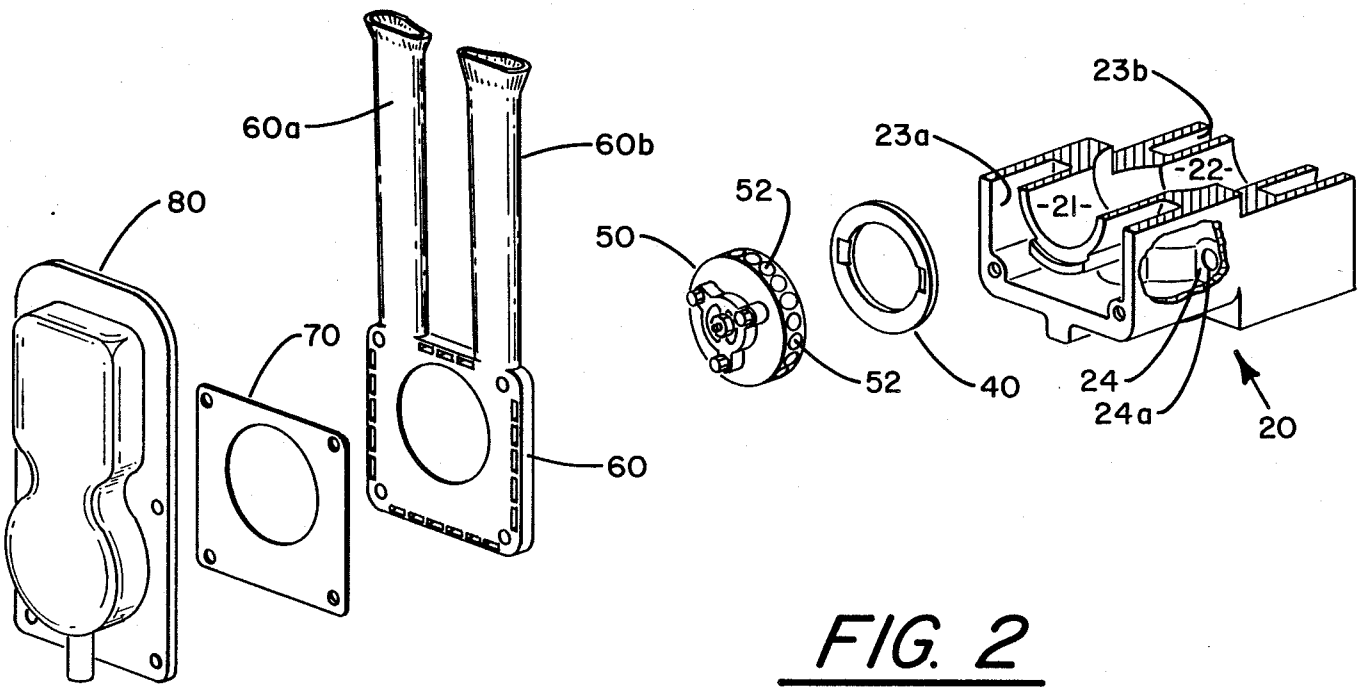
FIG. 2 is an exploded, partially sectioned view of the present invention.
Figure 3:
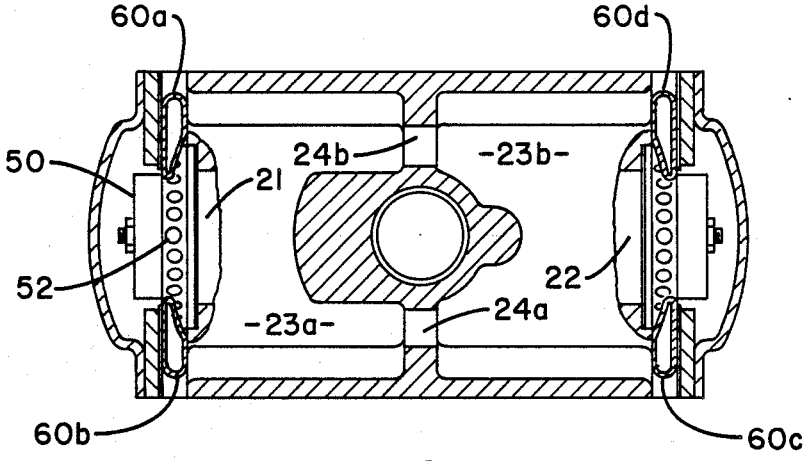
FIG. 3 is a horizontal sectional view showing the fluid paths.
Figure 4:
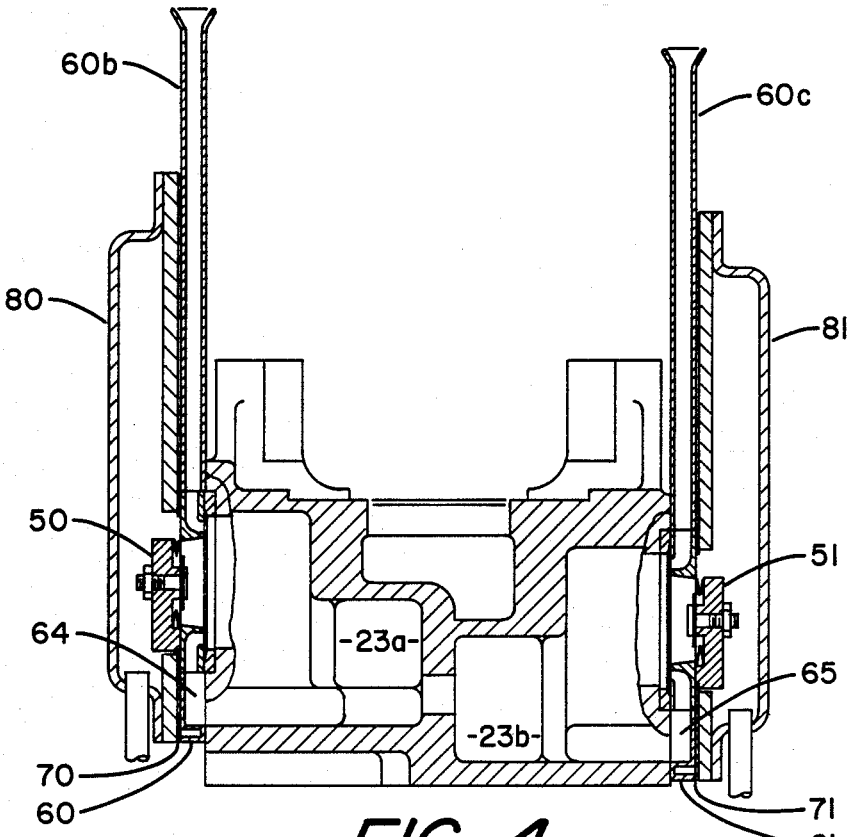
FIG. 4 is a vertical sectional view showing the fluid paths.
Figure 6:
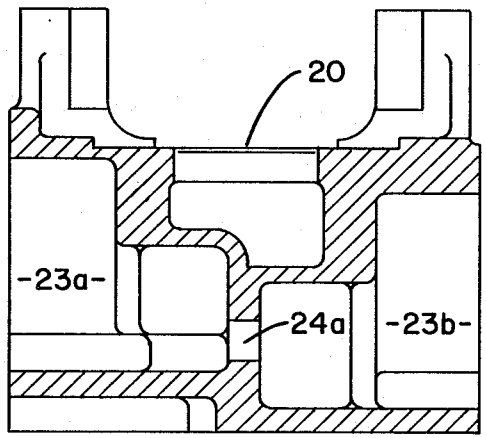
FIG. 6 is a sectional view taken along line VI—VI of FIG. 5.
Figure 5:
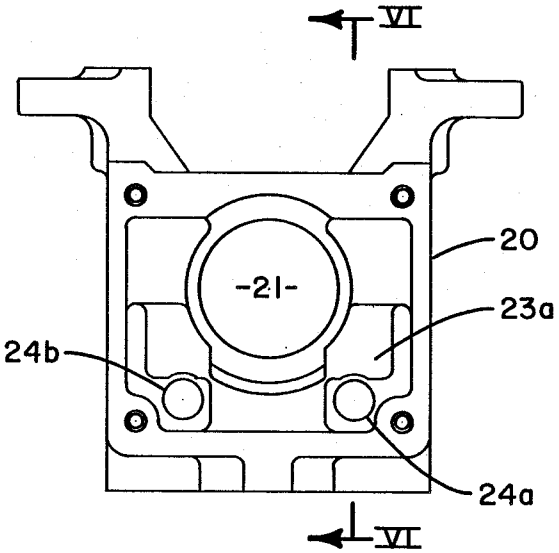
FIG. 5 is an end view of the crankcase.

The motor 14 includes a stator 15 and a rotor (not illustrated) which is operatively connected to drive the crankshaft (not illustrated) which is supported within the cylinder block 20. Referring now to FIG. 2-4, the cylinder block 20 receives the suction valve guide 40 which, in turn, receives the valve plate assembly 50. The valve plate assembly 50 is received within the suction inlet and seal 60. Cylinder head 80 is separated from seal 60 by gasket 70. The cylinder block 20, valve guide 40, valve plate assembly 50, seal 60, gasket 70 and cylinder head 80 are bolted together as a unit by bolts 90, as is best shown in FIG. 1.

Referring back to FIG. 2, it will be seen that cylinder block 20 defines two piston chambers 21 and 22 which are surrounded by the suction plenum. The suction plenum is divided into two parts, 23*a* and *b*, by a partition wall 24. The partition wall 24 has two apertures 24*a* and *b* formed therein to provide a restricted fluid communication between the two parts of the suction plenum 23*a* and *b*.

The details of the cylinder block are shown in more detail in FIGS. 3-6, however, FIGS. 3 and 4 have been taken along several sectional lines in order to show continuity of the fluid paths. As best shown in FIG. 3, there are two suction inlets and seals 60 and 61 which define four suction gas supply or inlet tubes 60*a–d* with tubes 60*a* and *b* communicating with plenum 23*a* and tubes 60*c* and *d* communicating with plenum 23*b*. Apertures 24*a* and *b* provide restricted communication between plenums 23*a* and *b*. Suction inlets and seals 60 and 61 are identical and surround valve plate assemblies 50 and 51, respectively, and are separated from cylinder heads 80 and 81 by gaskets 70 and 71, respectively.

Each one of the tubes 60*a–d* is in fluid communication with each one of the piston chambers 21 and 22 when the corresponding pistons are on the suction stroke. More specifically, tubes 60*a* and *b* discharge into suction plenum 23*a* while tubes 60*c* and *d* discharge into suction plenum 23*b*. Since suction plenums 23*a* and *b* are in fluid communication via apertures 24*a* and *b* in partition 24, there is a continuous fluid path between tubes 60*a–d* and both suction plenums 23*a* and *b*. Flow is uni-directional toward the suction plenum that is associated with a piston in the suction stroke.

Assuming that the piston associated with piston chamber 21 is on the suction stroke while the piston associated with piston chamber 22 is on the discharge stroke, a suction pressure will be established in suction plenum 23*a*. Refrigerant in the shell of the hermetic motor compressor unit 10 will then be drawn into tubes 60*a* and *b* and pass into the rectangular space 64 surrounding valve plate assembly 50. Rectangular space 64 is in direct fluid communication with suction plenum 23*a*. Refrigerant is drawn into piston chamber 21 from space 64 and plenum 23*a* via inlet openings 52. Because suction plenum 23*a* is at a vacuum relative to suction plenum 23*b*, additional refrigerant is drawn into plenum 23*a* from plenum 23*b* via apertures 24*a* and *b*. This, in turn, creates a vacuum in plenum 23*b* relative to the interior of the shell of hermetic compressor unit 10 causing refrigerant to be drawn into tubes 60*c* and *d*, through rectangular space 65 and into plenum 23*b*. Since the flow paths from tubes 60*a* and *b* to piston chamber 21 are much shorter than the flow paths from tubes 60*c* and *d* to piston chamber 21, as well as being unrestricted by apertures 24*a* and *b*, and, because of the short stroke duration, flow through tubes 60*a* and *b* is much greater than the flow through tubes 60*c* and *d*. However, there is flow through each of the tubes 60*a–d* so that there is no stoppage of flow and the resultant noise. The analogous situation exists when the piston associated with piston chamber 22 is in the suction stroke and the flow is much greater through tubes 60*c* and *d* than tubes 60*a* and *b*.

From the foregoing, it is obvious that the flow is continuous to each of the suction plenums even though the associated piston is on the discharge stroke. However, the flow does vary in the two suction plenums and associated tubes in accordance with which piston is in the suction stroke.

Although a preferred embodiment of the present invention has been illustrated and described, other changes will occur to those skilled in the art. For example, one or both of apertures 24*a* and *b* can be replaced with tubes to achieve further sound attenuation. It is, therefore, intended that the present invention is to be limited only by the scope o the appended claims.

What is claimed is:

1. A hermetic compressor suction pulse attenuator comprising:

a cylinder block defining a plurality of suction plenums;

each suction plenum having a piston chamber in fluid communication therewith;

each suction plenum having a corresponding suction supply means for supplying suction gas thereto;

restricted fluid communication means connecting each of said suction plenums for establishing fluid communication between each of said suction plenums whereby each of said piston chambers is additionally in restricted fluid communication with each of said suction supply means for each of the other plenums so that there is a continuous fluid flow in each of said suction supply means.

2. A two-cylinder hermetic compressor suction pulse attenuator comprising:

a cylinder block defining two suction plenums;

a first piston chamber associated with and in fluid communication with a first one of said suction plenums;

a second piston chamber associated with and in fluid communication with a second one of said suction plenums;

a first suction supply means for supplying suction gas to said first one of said two suction plenums;

a second suction supply means for supplying suction gas to said second one of said two suction plenums;

restricted fluid communication means connecting said first and second suction plenums for establishing restricted communication between said first and second suction plenums whereby said first piston chamber is in restricted fluid communication with said second suction supply means and second piston chamber is in restricted fluid communication with said first suction supply means.

3. The suction pulse attenuator of claim 2 wherein said restricted fluid communication between said first piston chamber and said second suction supply means is defined by a longer fluid path than that defined between said first suction supply means and said first piston chamber.

* * * * *